United States Patent [19]

Williams et al.

[11] 3,969,692

[45] July 13, 1976

[54] GENERALIZED WAVEGUIDE BANDPASS FILTERS

[75] Inventors: Albert Edward Williams, Bethesda; Ali Ezzeldin Atia, Gaithersburg, both of Md.

[73] Assignee: Communications Satellite Corporation (Comsat), Washington, D.C.

[22] Filed: Sept. 24, 1975

[21] Appl. No.: 616,479

[52] U.S. Cl. ..... 333/73 W; 333/83 R; 333/98 R

[51] Int. Cl.[2] ..... H01P 7/06; H01P 1/20

[58] Field of Search ..... 333/73 W, 83 R, 73 R, 333/98 R

[56] References Cited

UNITED STATES PATENTS

| | | | |
|---|---|---|---|
| 2,749,523 | 6/1956 | Dishal | 333/73 W |
| 3,882,434 | 5/1975 | Levy | 333/73 W |

*Primary Examiner*—Alfred E. Smith
*Assistant Examiner*—Marvin Nussbaum
*Attorney, Agent, or Firm*—Sughrue, Rothwell, Mion, Zinn & Macpeak

[57] ABSTRACT

A waveguide structure composed of circular waveguide cavities resonant in the $TE_{011}$ mode is capable of realizing the most general bandpass filter characteristics with significant decreases in filter loss and gain slope. In addition to the commonly used Tchebychev and Butterworth functions, the structure can realize general transfer functions including the elliptic function. In its simplest form, the structure is composed of four cylindrical cavities which form a building block for more complex filters. The first and second cavities and the third and fourth cavities each have their side walls in contact and their end walls in common planes. The third and fourth cavities are superposed to the first and second cavities with their adjacent end walls in a common plane, but the second and third cavities are offset so that they overlap at one-half diameters. The first and second cavities are coupled by means of a centrally located side wall slot, as are the third and fourth cavities. Coupling between the second and third cavities is by means of a radial slot in their adjacent end walls, and the first and fourth cavities are similarly coupled. However, to generate the most general class of coupled transfer functions, the sign of the coupling between the first and fourth cavities and between the second and third cavities must be different. This is accomplished by the offset of the second and third cavities.

6 Claims, 8 Drawing Figures

$E_r = 0$ $E_\theta = -J_0^1(k_1 r)\ \sin(\pi z/L)$ $E_z = 0$ $H_r = k_3/k\ J_0^1(k_1 r)\cos(\pi z/L)$ $H_\theta = 0$ $H_z = k_1/k\ J_0(k_1 r)\sin(\pi z/L)$ WHERE $k_1 = 7.664/D$ $k_3 = \pi/L$, $k^2 = k_1^2 + k_3^2$

L = CAVITY LENGTH , D = CAVITY DIAMETER

GENERALIZED WAVEGUIDE BANDPASS FILTERS

BACKGROUND OF THE INVENTION

1. Field of the Invention

The present invention generally relates to waveguide bandpass filters, and more particularly, to waveguide structures which realize the general coupled cavity transfer function in the high Q circular $TE_{011}$ mode.

2. Description of the Prior Art

High-quality microwave communications system applications require narrow-bandpass filters possessing good frequency selectivity, linear phase, and small in-band insertion loss. Although direct coupled resonator filters are relatively simple structures, their insertion loss functions are restricted to all-pole functions, e.g. Butterworth or Tchebychev functions. The applicants have shown that optimum waveguide bandpass filters whose insertion loss functions have ripples in the passband and real finite zeros of transmission in the stopband, can be constructed by using dual-mode multiple coupled cavities. See A. E. Atia and A. E. Williams, "Narrow-Bandpass Waveguide Filters," *IEEE Transactions on Microwave Theory and Techniques*, Vol.MTT-20, No. 4, April 1972, pp. 258–265. These filters still require separate group delay equalizers, however.

Since it is known that cascading a non-minimum phase network with an all-pass network results in a network of a higher degree than is actually necessary for a particular application, direct realization of a general non-minimum phase transfer function would offer considerable advantages. Unfortunately, the existing analytical solution to the approximation problem of optimizing both the amplitude and phase responses of a filter transfer function over the same finite band of frequencies does not yield the most optimum characteristics. The existing analytical solution to the approximation problem is described by J. D. Rhodes, "A Low-Pass Prototype Network for Microwave Linear Phase Filters," *IEEE Transactions on Microwave Theory and Techniques*, Vol. MTT-18, No. 6, June 1970, pp. 309–313. See also U.S. Pat. No. 3,597,709 to J. D. Rhodes. While Rhodes' waveguide realization of the linear phase filter produces excellent group delay response, its monotonic out-of-band amplitude characteristics are far from optimum. Moreover, Rhodes' theory does not contemplate the realization of an elliptic function bandpass filter.

U.S. Pat. No. 3,697,898 to B. L. Blachier and A. R. Champeau describes a plural cavity bandpass waveguide filter which provides an elliptic function response. The Blachier and Champeau filter employs a plurality of waveguide cavities each of which resonate in two independent orthogonal modes. Such cavities may be realized by using either circular or square waveguides. Coupling within the cavities is provided by structural discontinuities such as a screw, and coupling between cavities is provided by a polarization discriminating iris. The coupling is such as to produce a phase inversion and hence subtraction between selected identical modes in coupled cavities thereby providing the steep response skirts for the passband of the filter which are characteristic of the elliptic function.

A particular advantage of the Blachier and Champeau filter is that it provides superior filter characteristics in a limited volume; both factors which are very important in satellite and space applications. Dual mode cavities, however, require more precise machining than single mode cavities, and when used in the Blachier and Champeau filter, also require intra cavity mode coupling.

Filters constructed from rectangular, square or circular cavities are typically designed to oscillate in the fundamental $TE_{101}$ or $TE_{111}$ modes, respectively. For silver-plated waveguide cavities at 12 GHz, unloaded Q's of 5500 are usually obtained. However, for specific applications such as satellite transponders where a channelizing set of narrow band filters are required, such a Q may not be adequate, especially if the bandwidths are less than 1%.

The obvious way to improve the realizable filter unloaded Q is to employ a higher order cavity mode, although practical problems related to the control of lower order modes are introduced. Nevertheless, one mode which has been successfully employed is the circular $TE_{011}$ mode. Direct coupled cavity bandpass filters have been constructed having practical Q's of at least three times those of the fundamental mode. See, for example, Matthaei, Young and Jones, *Microwave Filters, Impedance-Matching Networks, and Coupling Structures*, McGraw-Hill Book Company (1964), pp. 924–934. These filters will realize Butterworth, Tchebychev or augmented linear phase filter functions, i.e., those functions which can be generated with all positive (or all negative) intercavity coupling. Filter transfer functions having real zeros of transmission or filters having negative coupling are not possible with such a structure and have not been previously described in literature.

SUMMARY OF THE INVENTION

It is therefore an object of the present invention to provide a waveguide bandpass filter structure which realizes the general coupled cavity transfer function in the high Q circular $TE_{011}$ mode.

This and other objects are attained by providing a waveguide structure composed of circular waveguide cavities. In its simplest form, the structure is composed of four cylindrical cavities which form a building block for more complex filters. The first and second cavities and the third and fourth cavities each have their side walls in contact and their end walls in common planes. The third and fourth cavities are superposed to the first and second cavities with their adjacent end walls in a common plane, but the second and third cavities are offset so that they overlap at one-half diameters. The filter input to the first cavity is by means of an input coupling slot. The first and second cavities are coupled by means of a centrally located side wall slot along the line where the side walls of the two cavities are in contact. The coupling thus obtained is by the longitudinal magnetic field ($H_z$). Coupling between the second and third cavities is by means of a radial slot in their adjacent end walls to obtain coupling by the radial magnetic field ($H_r$). Coupling between the third and fourth cavities is similar to that between the first and second cavities, and the output of the filter is by means of an output coupling slot in the fourth cavity. To generate the most general class of coupled transfer fractions, coupling between the first and fourth cavities must be made, and this is accomplished by means of a radial slot in their adjacent end walls. Further, the sign of the coupling between the first and fourth cavities and between the second and third cavities must be different. This is accomplished by the offset of the third cavity with respect to the second cavity. This arrangement causes the radial magnetic fields in the second and third cavities to be in different directions while the radial magnetic fields in the first and fourth cavities are in the same direction. The four cavities of this arrangement produce a pair of real zeros of transmission, and a general fourth order elliptic response with cavity Q's of 15,000 at 12 GHz are obtained. The arrangement is readily extended to any number of odd or even cavities, and more general transfer functions are obtained.

BRIEF DESCRIPTION OF THE DRAWINGS

The specific nature of the invention, as well as other objects, aspects, uses and advantages thereof, will clearly appear from the following description and from the accompanying drawings, in which.

DESCRIPTION OF THE PREFERRED EMBODIMENT

Figure 1:
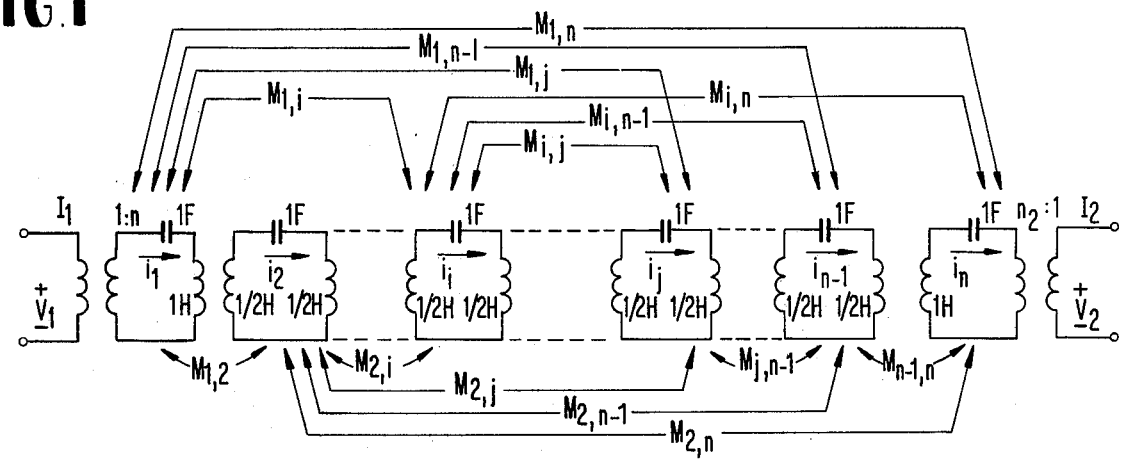
FIG. 1 shows an equivalent circuit of $n$ narrowband synchronously tuned cavities coupled in an arbitrary fashion.

The general two port equivalent circuit of n coupled cavities is shown in FIG. 1. The cavities are all tuned to the same normalized center frequency $\omega_o = 1/\sqrt{LC} =$ 1 rad/sec and have the normalized characteristic impedance $Z_o = \sqrt{L/C} = 1$ ohm. In the synthesis of such a circuit, a narrow band approximation using a lumped element representation of a cavity is made, and the $n \times n$ symmetric coupling impedance matrix $jM$ (having zero diagonal entries but otherwise arbitrary signs on the entries) is purely imaginary and frequency independent near $\omega_o$.

Using the bandpass frequency variable $$P = p + l/p ,$$

the loop impedance matrix $Z_l$ (P) can be written as $$Z_l(P) = Pl_n + jM , \quad (1)$$

where $l_n$ is the $n \times n$ identity matrix. Considering the structure as a two port network with input and output ideal transformers, the admittance matrix can be written as $Z_l^{-1} = Y_l$.

$$Y = \begin{bmatrix} Y_{11} Y_{12} \\ Y_{21} Y_{22} \end{bmatrix} = \left[\begin{array}{c|c} n_1^2 Y_{l11} & -n_1 n_2 Y_{ln1} \\ \hline -n_1 n_2 Y_{ln1} & n_2^2 Y_{lnn} \end{array}\right] , \quad (2)$$

where $n_1$ and $n_2$ are the input and output transformer turnratios. Further, $$Y_l(P) = Z_l^{-1}(P) = (P1_n + jT\Lambda T^t)^{-1}$$
$$= t \operatorname{diag} \left[ \frac{1}{P + j\lambda_1}, \ldots \frac{1}{P + j\lambda_n} \right] T^t , \quad (3)$$

where $\Lambda = \operatorname{diag}(\lambda_1, \lambda_2, \ldots \lambda_n)$, since $M$ is a real symmetric matrix and can be diagonalized to its eigen values ($\Lambda$) by a real orthogonal T, i.e., $M = T\Lambda T^t$.

Solution of the synthesis problem, i.e., the construction of a coupling matrix $M$ from a given transfer function, has been described by A. E. Atia, A. E. Williams, R. W. Newcomb, "Narrow-band Multiple-coupled Cavity Synthesis," *IEEE Transactions on Circuits and Systems*, Cas-21, No. 5, Sept. 1974. Synthesis begins by determining from the given transfer function the input and transfer admittances. A general T matrix, and hence $M$ matrix, may then be computed using equations (3) and (4).

In general, $M$ can always be written in the form $$M = T\Lambda T^t = \left[\begin{array}{c|c} O_m & C \\ \hline C & O_m \end{array}\right] , \quad (4)$$

where matrix C has all non-zero entries. However, in practice this will represent an excessive number of couplings and some means must be found of reducing some to zero. This can be achieved by applying Given's procedure to reduce C to a tridiagonal form. Such a form represents a unique solution to the coupling coefficients. For the common practical case where a symmetrical structure is required, the even (or odd) mode will occur in the unique tridiagonal Given's form.

Figure 2:
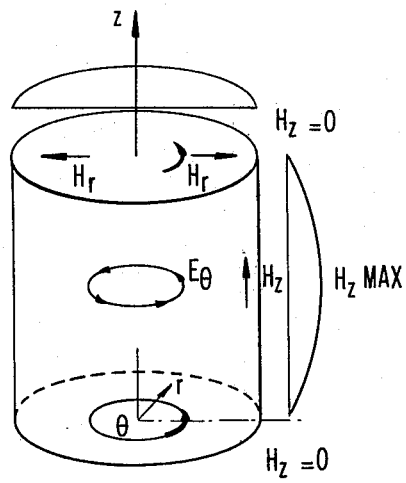
FIG. 2 illustrates the electric and magnetic fields of the $TE_{011}$ circular mode.
Figure 3A:
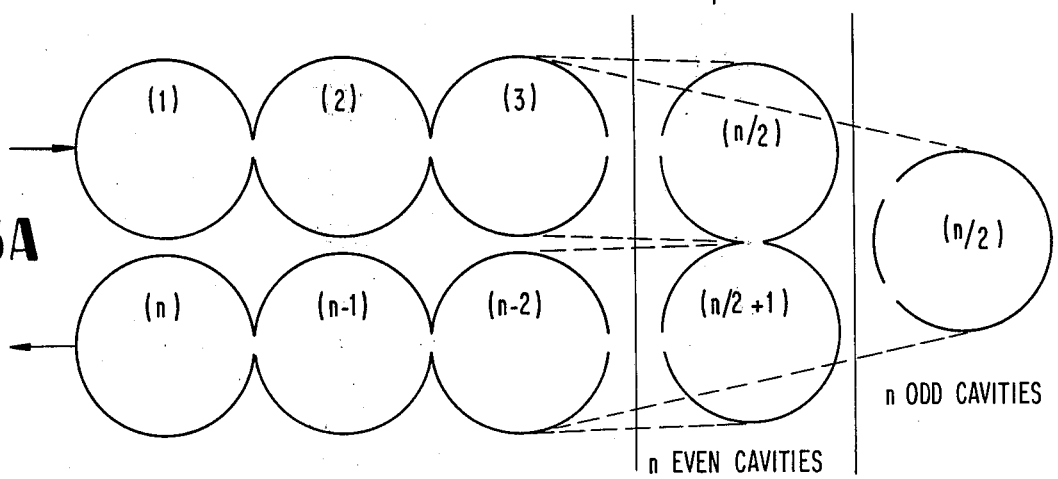
FIGS. 3A and 3B show a cavity structure utilizing side wall longitudinal magnetic field coupling.
Figure 3B:
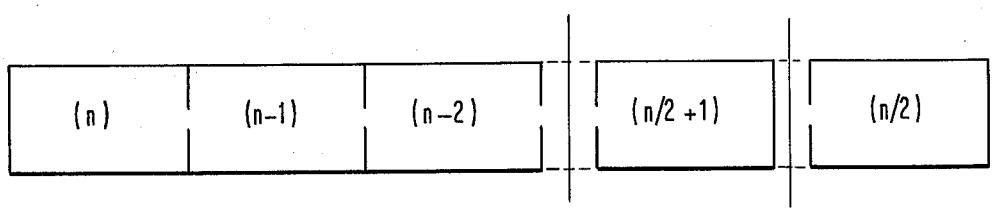
Figure 4A:
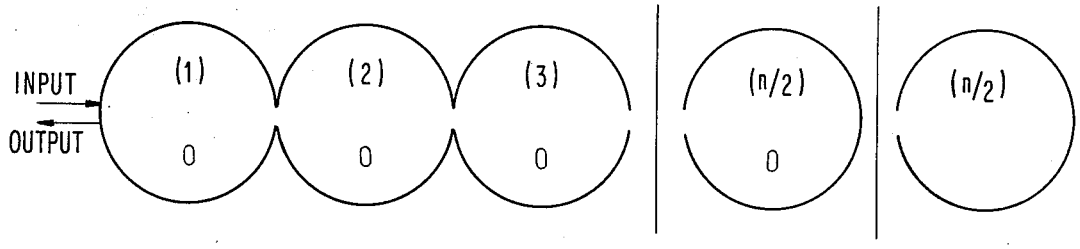
FIGS. 4A and 4B show a cavity structure utilizing both side wall longitudinal magnetic field coupling and end wall radial magnetic field coupling.
Figure 4B:
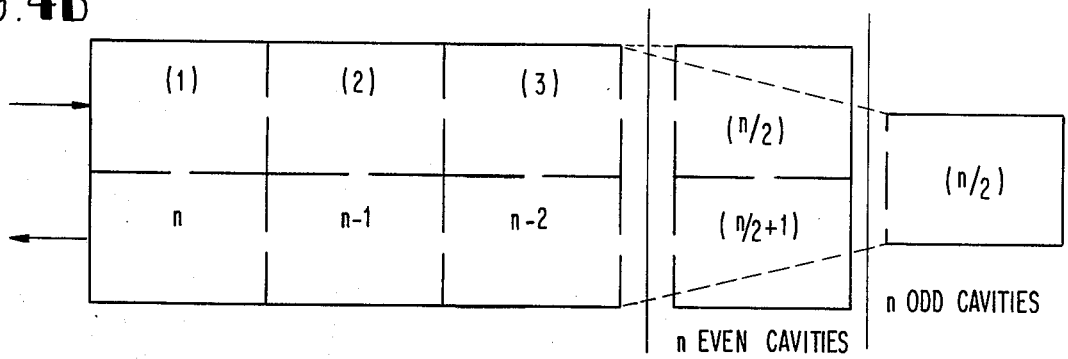

The electric and magnetic fields of the $TE_{011}$ circular mode are illustrated in FIG. 2. Intercavity coupling previously described in literature utilizes the side wall magnetic field, although an alternative method of coupling via the radial end wall magnetic field may also be employed as will be apparent from FIG. 2. FIGS. 3A and 3B show a cavity structure wherein only the side wall magnetic field $H_z$ is used for intercavity coupling. This structure is composed of cylindrical cavities numbered 1 to $n$, and for convenience, the structure is shown folded. Note that the number of cavities may be either even or odd. FIGS. 4A and 4B show a cavity structure wherein both the side wall magnetic field $H_z$ and the end wall magnetic field are used for intercavity coupling. This structure is also composed of cylindrical cavities numbered 1 to n where n may be either even or odd. However, in this structure, cavities are superposed to permit end wall coupling. It is important to note that both geometries shown in FIGS. 3A and 3B and FIGS. 4A and 4B generate couplings of the same sign.

Figure 5A:
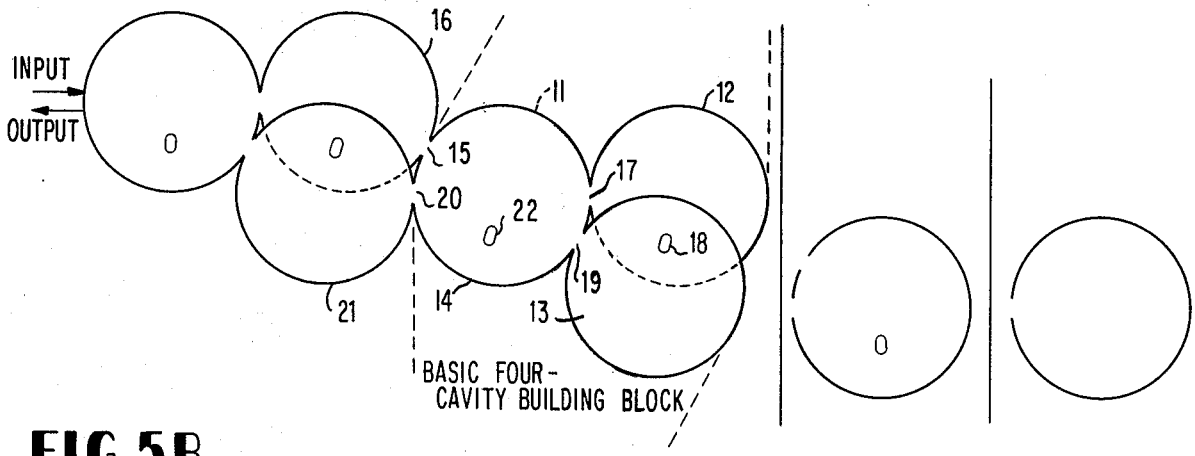
FIGS. 5A and 5B show the cavity structure according to the preferred embodiment of the present invention.
Figure 5B:
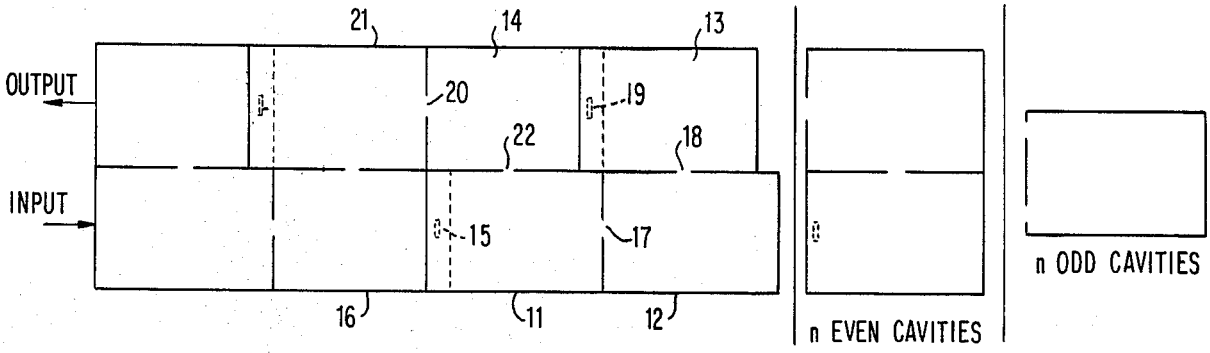

The realization of filter transfer functions which rerequire both negative and positive matrix couplings, e.g., those having real zeros of transmission in circular $TE_{011}$ mode cavities, utilize, like the geometry in FIGS. 4A and 4B, both side wall and end wall couplings, but by positioning the cavity ends at overlapping half diameters, negative couplings are generated. The geometry for the general structure is shown in FIGS. 5A and 5B. The basic building block of this general filter is a set of four electrical cavities as indicated by the dotted lines in FIG. 5A. With reference to this set of four cavities, cavities 11, 12, 13 and 14 will be referred to as the first, second, third and fourth cavities, respectively. The input to the first cavity 11 of the filter section is by means of the input coupling slot 15 centrally located along the lines where the side walls of cavity 11 and the preceding cavity 16 are in contact. Coupling between the first cavity 11 and the second cavity 12 is by means of a slot 17 located where those side walls are in contact. The second cavity 12 and the third cavity 13 are coupled by means of a radial slot 18 located in that portion of their end walls which overlap. The third and fourth cavities, 13 and 14, are coupled by a slot 19 in their side walls, and the output of the filter section is by means of a slot 20 between the fourth cavity and the succeeding cavity 21. To generate the most general class of coupled transfer functions, coupling between the first cavity 11 and the fourth cavity 14 must be made, and this is accomplished by means of the radial slot 22 in the end walls of those two cavities.

From FIG. 2, it will be recognized that slots 15, 17, 19 and 20 provide coupling by means of the longitudinal magnetic field $H_z$. Slots 18 and 22 provide coupling by means of the radial magnetic field $H_r$. However, because of the offset between cavities 12 and 13 so that they overlap at one half diameters, the sign of the coupling between these cavities is different than that between cavities 11 and 14. This is due to the fact that the radial magnetic fields in the second and third cavities are in opposite directions at slot 18, whereas the radial magnetic fields at slot 22 in cavities 11 and 14 are in the same direction. The four cavities of this arrangement thus produce a pair of real zeros of transmission, and a general fourth order elliptic response with cavity Q's of 15,000 at 12 GHz has been obtained.

As is apparent from FIGS. 5A and 5B, the basic four cavity building block is readily expanded to more complex filter structures. It will therefore be understood that the embodiment shown is only exemplary and that various modifications can be made in construction and arrangement within the scope of the invention as defined in the appended claims.

What is claimed is:

1. A generalized $TE_{011}$ mode waveguide filter comprising:

at least first, second, third and fourth cylindrical cavities, each of said cavities being tuned to resonate in the $TE_{011}$ mode at a common center frequency, first coupling means connecting said first and second cavities through their side walls for coupling resonant energy between said first and second cavities, second coupling means connecting said third and fourth cavities through their side walls for coupling resonant energy between said third and fourth cavities, third coupling means connecting said second and third cavities through their end walls for coupling resonant energy between said second and third cavities, and fourth coupling means connecting said first and fourth cavities through their end walls for coupling resonant energy between said first and fourth cavities.

2. A wave guide filter as recited in claim 1, wherein said first and second cavities and said third and fourth cavities each have their respective side walls in contact and their respective end walls are in common planes, and said third and fourth cavities are superposed to said first and second cavities with their adjacent end walls in a common plane.

3. A waveguide filter as recited in claim 2, wherein said first coupling means is a centrally located slot positioned along the line of contact of said first and second cavities, said second coupling means is a centrally located slot positioned along the line of contact of said third and fourth cavities, said third coupling means is a radial slot in the end walls of said second and third cavities, and said fourth coupling means is a radial slot in the end walls of said first and fourth cavities, said first and second coupling means being effective to couple longitudinal magnetic fields between cavities, and said third and fourth coupling means being effective to couple radial magnetic fields between cavities.

4. A waveguide filter as recited in claim 3, wherein the sign of the coupling produced by said third coupling means is different from the sign of the coupling means produced by said fourth coupling means.

5. A waveguide filter as recited in claim 4, wherein said second and third cavities are offset from one another so that they overlap at one-half diameters, and said first and fourth cavities are concentric.

6. A waveguide filter as recited in claim 5, further comprising input coupling means for coupling energy into said first cavity, and output coupling means for coupling energy out of said fourth cavity.

* * * * *